US005249913A

United States Patent [19]

Hosoya

[11] Patent Number: 5,249,913

[45] Date of Patent: Oct. 5, 1993

[54] SHEET TRANSPORTING DEVICE

[75] Inventor: Takahiro Hosoya, Tokyo, Japan

[73] Assignee: NEC Corporation, Tokyo, Japan

[21] Appl. No.: 887,497

[22] Filed: May 26, 1992

[30] Foreign Application Priority Data

May 24, 1991 [JP] Japan ..... 3-149522

[51] Int. Cl.[5] ..... B65G 13/06

[52] U.S. Cl. ..... 414/789.6; 414/790.5; 414/790.6

[58] Field of Search ..... 414/789.6, 794.8, 790.5, 414/790.6; 271/9, 69, 273

[56] References Cited

U.S. PATENT DOCUMENTS 3,568,578 3/1971 Fujishiro ..... 414/790.5 X
3,785,508 1/1974 Hayden ..... 414/789.6
4,718,807 1/1988 Baxter ..... 414/794.8 X

*Primary Examiner*—Robert P. Olszewski
*Assistant Examiner*—Cheryl L. Gastineau
*Attorney, Agent, or Firm*—Foley & Lardner

[57] ABSTRACT

A sheet transporting device having a plurality of sheet pay-out mechanisms. A pick-up mechanism is associated with each of the pay-out mechanisms and carries rollers therewith. The pick-up mechanism draws out a sheet from the associated pay-out mechanism and then bodily rotates to accommodate the sheet in a collection mechanism. Such a procedure is repeated the number of times corresponding to the number of pick-up mechanisms existing in the device. Hence, despite that the device has a plurality of pay-out mechanisms, it is possible to collect all the sheets in a single collection mechanism and drive them out collectively to the outside of the device via a single outlet.

3 Claims, 13 Drawing Sheets

SHEET TRANSPORTING DEVICE

BACKGROUND OF THE INVENTION

The present invention relates to a sheet transporting device having a plurality of sheet pay-out mechanisms.

It has been customary with the above-described type of sheet transporting device to provide each of the plurality of sheet pay-out mechanisms with an exclusive outlet. The problem with such a conventional arrangement is that picking up sheets from the plurality of outlets by hand is time-consuming and inefficient. Moreover, the operator may even forget to take out sheets from some of the outlets.

SUMMARY OF THE INVENTION

It is therefore an object of the present invention to provide a sheet transporting device capable of dispensing a plurality of sheets via a single outlet, thereby enhancing an efficient operation.

A sheet transporting device of the present invention comprises a plurality of pay-out mechanisms for paying out sheets, a plurality of pick-up mechanisms each being associated with respective one of the plurality of pay-out mechanisms, a collection mechanism for sequentially collecting sheets picked up by the plurality of pick-up mechanisms by gravity, a transfer mechanism for receiving the sheets collected by the collection mechanism collectively, and a transport mechanism for transporting the sheets received by the transfer mechanism to the outside of the device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
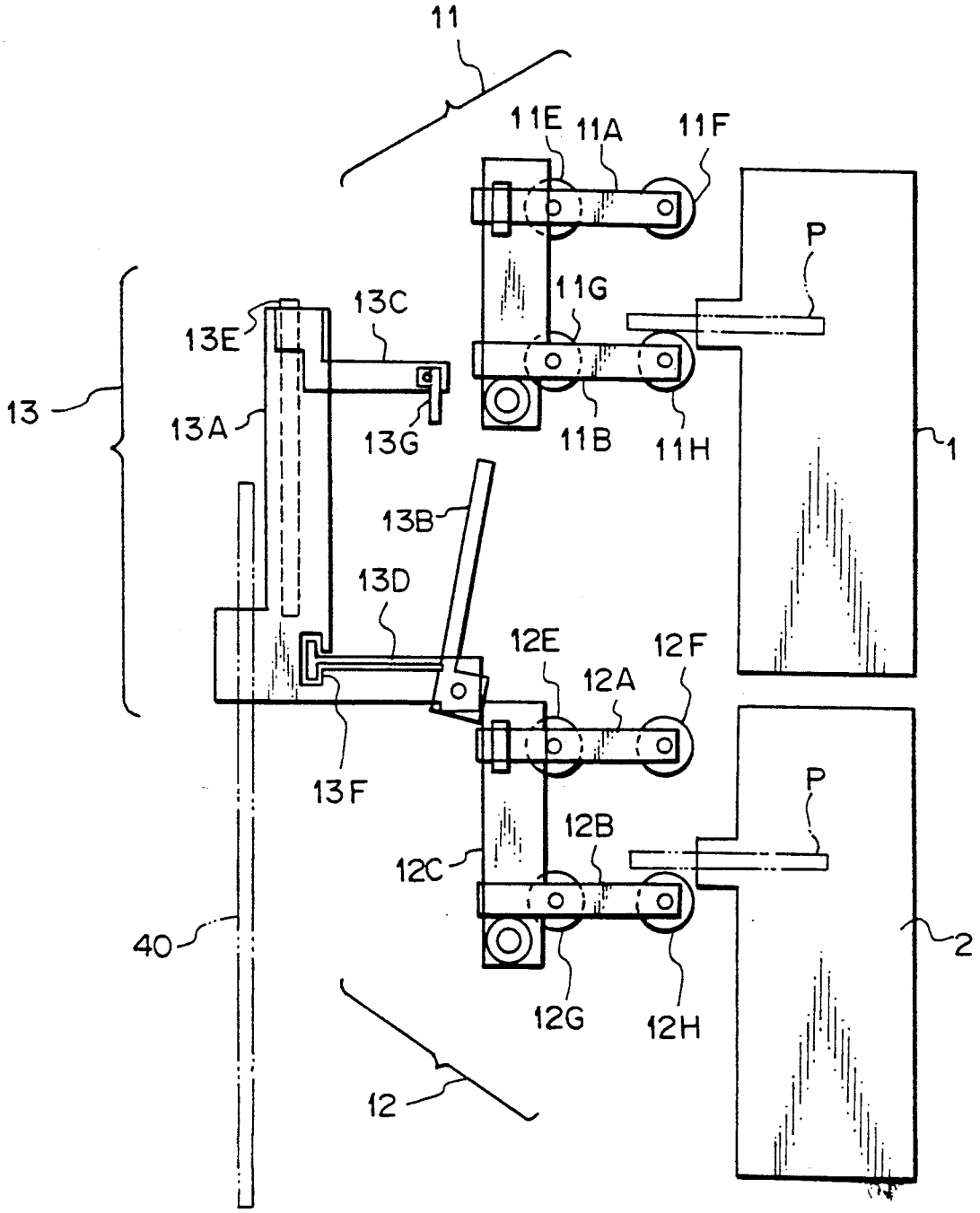
FIG. 1 is a front view of a sheet collecting section included in a sheet transporting device embodying the present invention.
Figure 2:
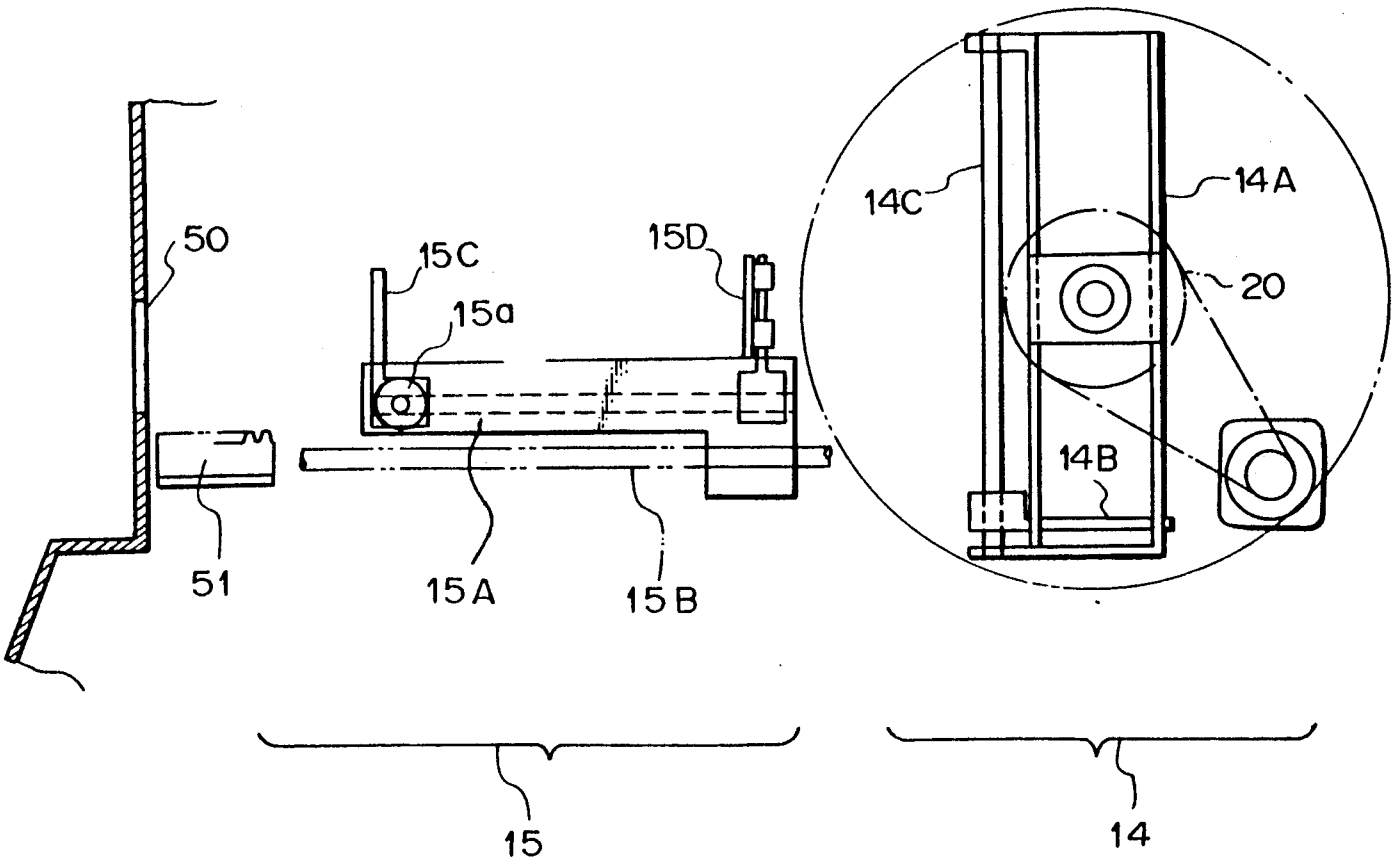
FIG. 2 is a front view of a sheet delivering section also included in the sheet transporting device.

A sheet transporting device embodying the present invention is generally made up of a sheet collecting section shown and a sheet delivering section shown in FIGS. 1 and 2, respectively. As shown in FIG. 1, the sheet collecting section has a plurality of pay-out mechanisms 1 and 2, and a plurality of pick-up mechanisms 11 and 12 associated one-to-one with the pay-out mechanisms 1 and 2. A collection mechanism 13 sequentially collects sheets P drawn out by the pick-up mechanisms 11 and 12 by gravity. As shown in FIG. 2, the sheet delivering section has a transfer mechanism 14 and a transport mechanism 15. The transfer mechanism 14 receives all the sheets P collected by the collection mechanism 13 at a time and feeds them out together via the transport mechanism 15.

Figure 4:
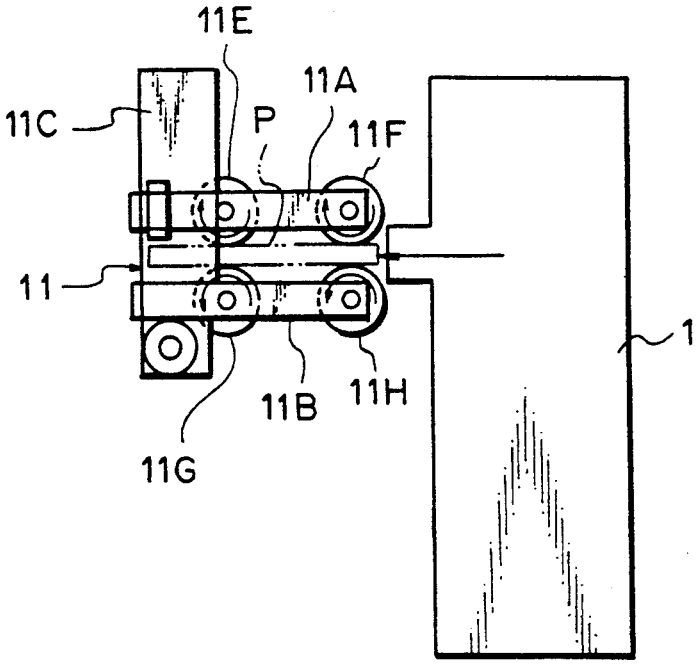
Figure 5:
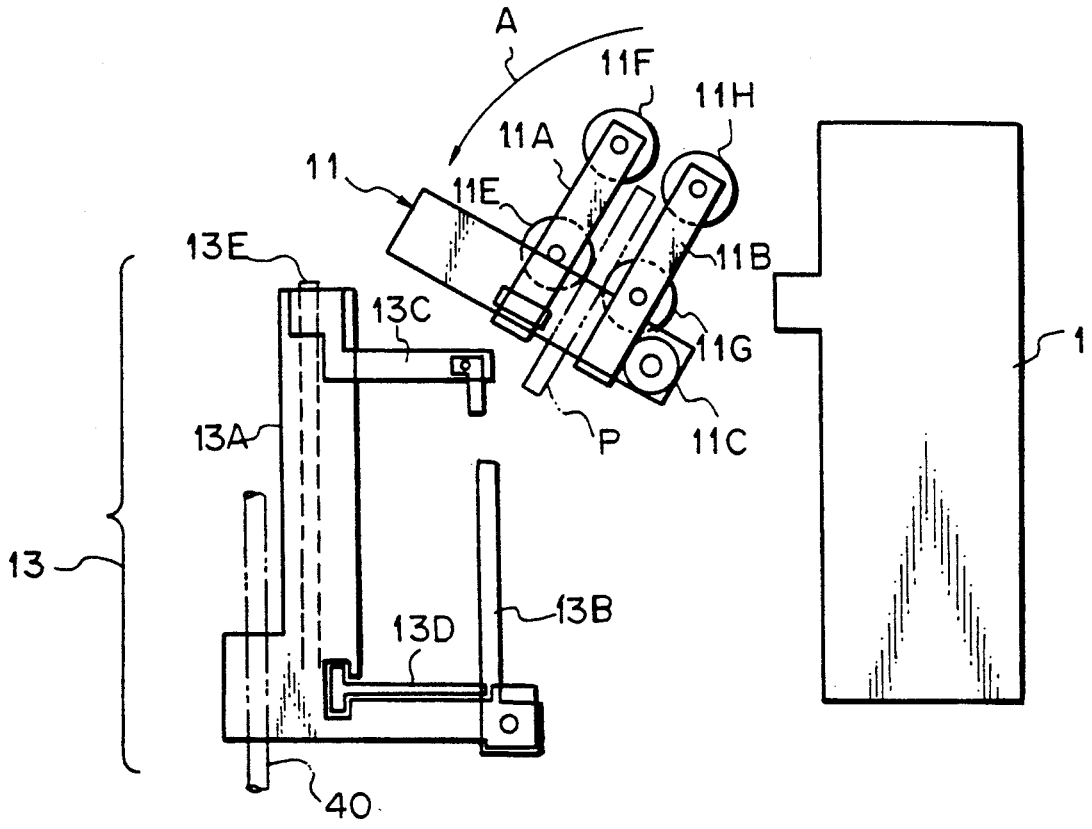

The pick-up mechanism 11 has an upper and a lower hand 11A and 11B extending toward the pay-out mechanism 1, and a support 11C supporting the hands 11A and 11B. The upper and lower hands 11A and 11B are respectively provided with two rollers 11E and 11F and two rollers 11G and 11H. The upper hand 11A is movable toward and away from the lower hand 11B in a reciprocating motion (see FIGS. 3 and 4). The hands 11A and 11B, therefore, cooperate to nip and feed out the sheet P paid out from the pay-out mechanism 1. As shown in FIG. 5, the pick-up mechanism 11 is rotatable in a direction indicated by an arrow A, as needed. This allows the sheet P in the pick-up mechanism 11 to fall into the collection mechanism 13.

The other pick-up mechanism 12 is constructed and operated in exactly the same manner as the above-described pick-up mechanism 11.

As shown in FIG. 1, the collection mechanism 13 is supported and guided by a guide rod 40 so as to be movable up and down along the pick-up mechanisms 11 and 12. The collection mechanism 13 has a generally L-shaped receptacle 13A and a gate 13B which is journalled to the receptacle 13A at the lower end thereof to be rotatable toward and away from the pick-up mechanisms 11 and 12. An upper slider 13C extends from an upper end portion of the receptacle 13A toward the upper end of the gate 13B and is movable up and down while maintaining the horizontal position thereof. A lower slider 13D is mounted on the lower end of the receptacle 13A and slidable in a direction perpendicular to the sheet surface of FIG. 1. The upper slider 13C and lower slider 13D cooperate to drive a plurality of collected sheets P into the transfer mechanism 14 at a time. The upper slider 13C is guided by a guide rod 13E while the lower slider 13D is received in and guided by a channel 13F in the above-mentioned direction, i.e., horizontal direction. The upper slider 13C carries a sheet holder 13G at the free end thereof.

As shown in FIG. 2, the transfer mechanism 14 has a generally U-shaped receptacle 14A, a push slider 14B mounted on the bottom of the receptacle 14 in a horizontal position and movable up and down in a reciprocating motion, and a linear shaft 14C for guiding the reciprocating motion of the push slider 14B. Drive control means 20 is associated with the receptacle 14A for causing the receptacle 14A to fall sideways from the upright position shown in FIG. 2. When the transfer mechanism 14 loaded with a plurality of sheets P falls sideways by being driven by the drive control means 20, the push slider 14B pushes the sheets P into the transport mechanism 15, as will be described with reference to FIGS. 13–15.

Figure 14:
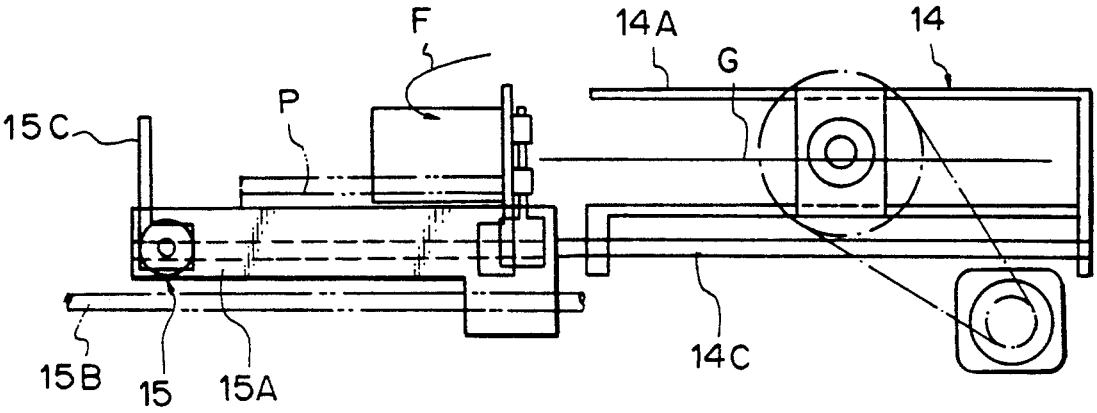
Figure 15:
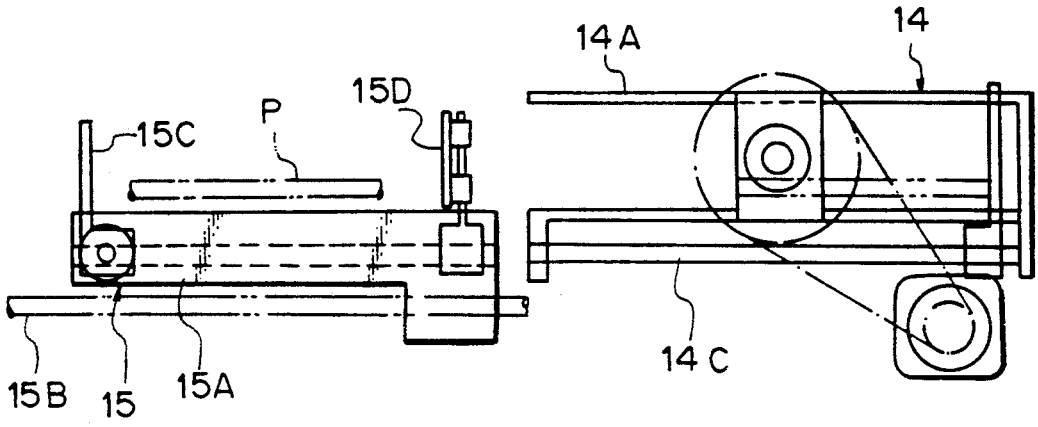
Figure 16:
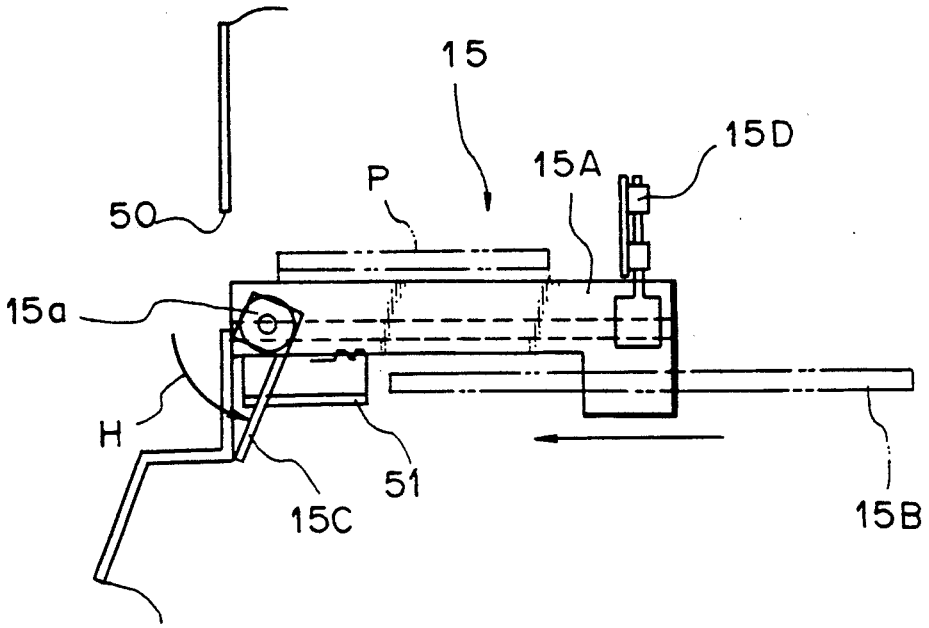

The transport mechanism 15 has a carriage 15A for transporting the sheets P fed from the transfer mechanism 14 (see FIGS. 13–15) toward an outlet 50, a linear shaft 15B on which the carriage 15A is movably mounted, a stop 15C located at the upper left end of the carriage 15A, as viewed in FIG. 2, and a discharge plate 15D located at the upper right end of the carriage 15A. When the carriage 15A reaches a predetermined position close to the outlet 50, the stop 15C is rotated counterclockwise by a rack 51 and a pinion **15*a* to a position shown in FIG. 16, facilitating the discharge of the sheets P. The rack 51 is positioned at the inside of the outlet 50 while the pinion 15*a* is located at the center of rotation of the stop 15C to mesh with the rack 51. As the carriage 15A approaches the outlet 50, the discharge plate 15D is operated to push the sheets P toward the outlet 50, as shown in FIG. 16. As a result, the sheet stack P is collectively driven out to a predetermined position via the outlet 50**.

Figure 3:
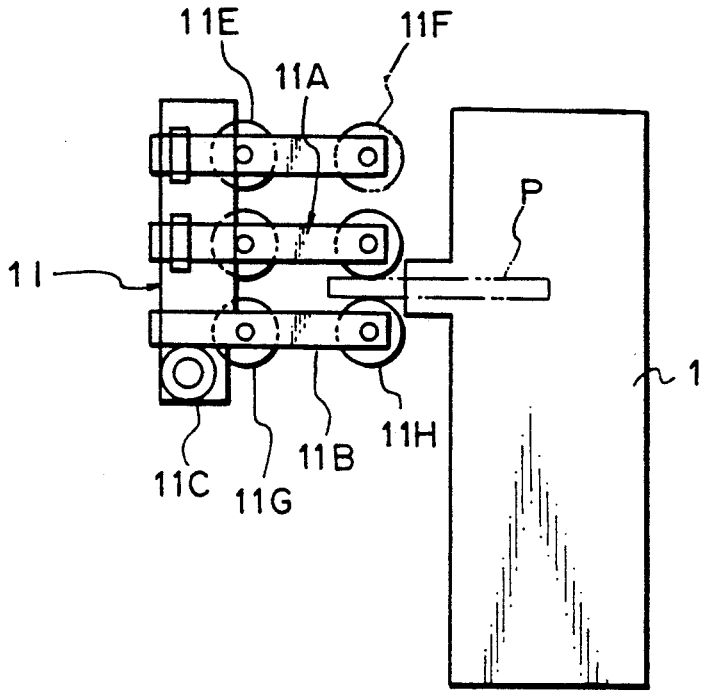
FIGS. 3–10 are views demonstrating the operation of the sheet collecting section shown in FIG. 1.
Figure 6:
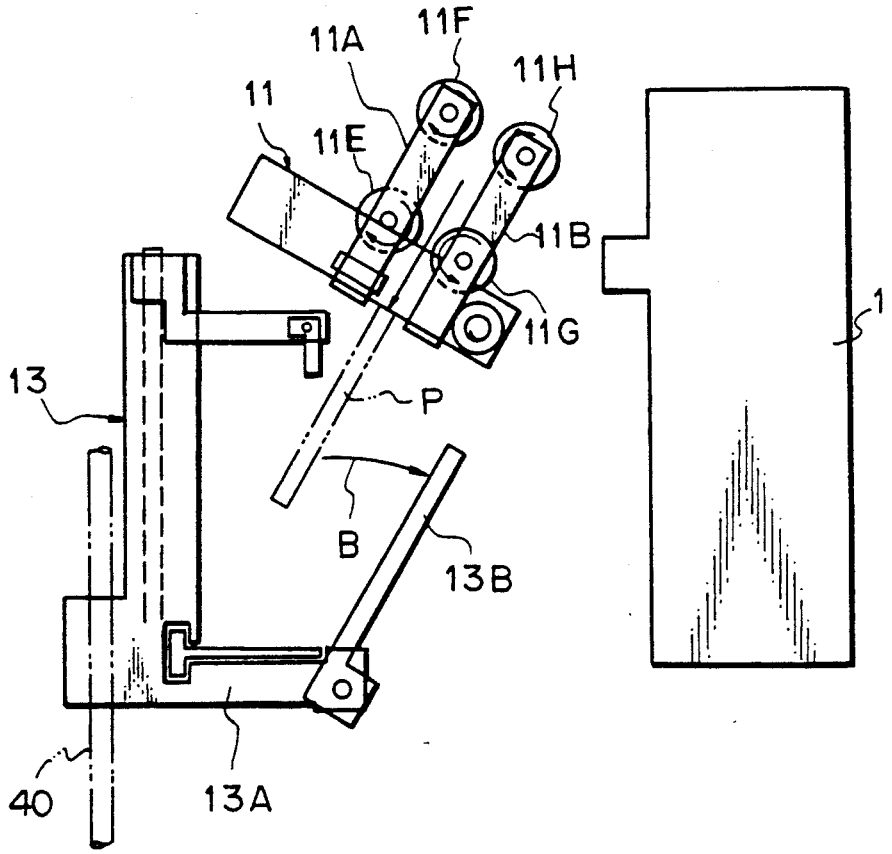
Figure 7:
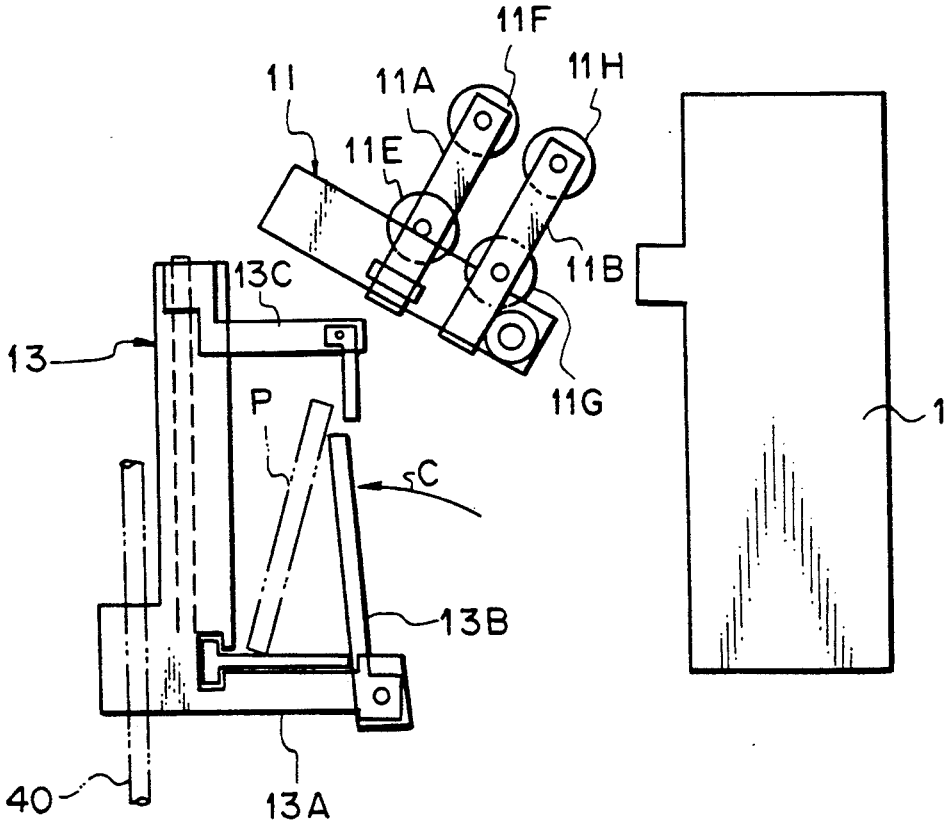

In operation, the upper hand 11A of the pick-up mechanism 11 is slid downward to nip a sheet P paid out from the pay-out mechanism 1 in cooperation with the lower hand 11B, as shown in FIG. 3. Then, the rollers 11E, 11F, 11G and 11H mounted on the hands 11A and 11B are driven to fully draw out the sheet P from the pay-out mechanism 11, as shown in FIG. 4. Subsequently, the collection mechanism 13 is brought to a position obliquely downwardly of the pick-up mechanism 11, and then the pick-up mechanism 11 is bodily rotated in the direction A, as shown in FIG. 5. While the pick-up mechanism 11 is being rotated in the direction A, the gate 13B of the collection mechanism 13 is opened in a direction indicated by an arrow B in FIG. 6. Thereafter, the rollers 11E, 11F, 11G and 11H are driven again so as to feed the sheet P into the collection mechanism 13. As the gate 13B is rotated in a direction C, FIG. 7, the sheet P is fully accommodated in the receptacle 13A.

Figure 8:
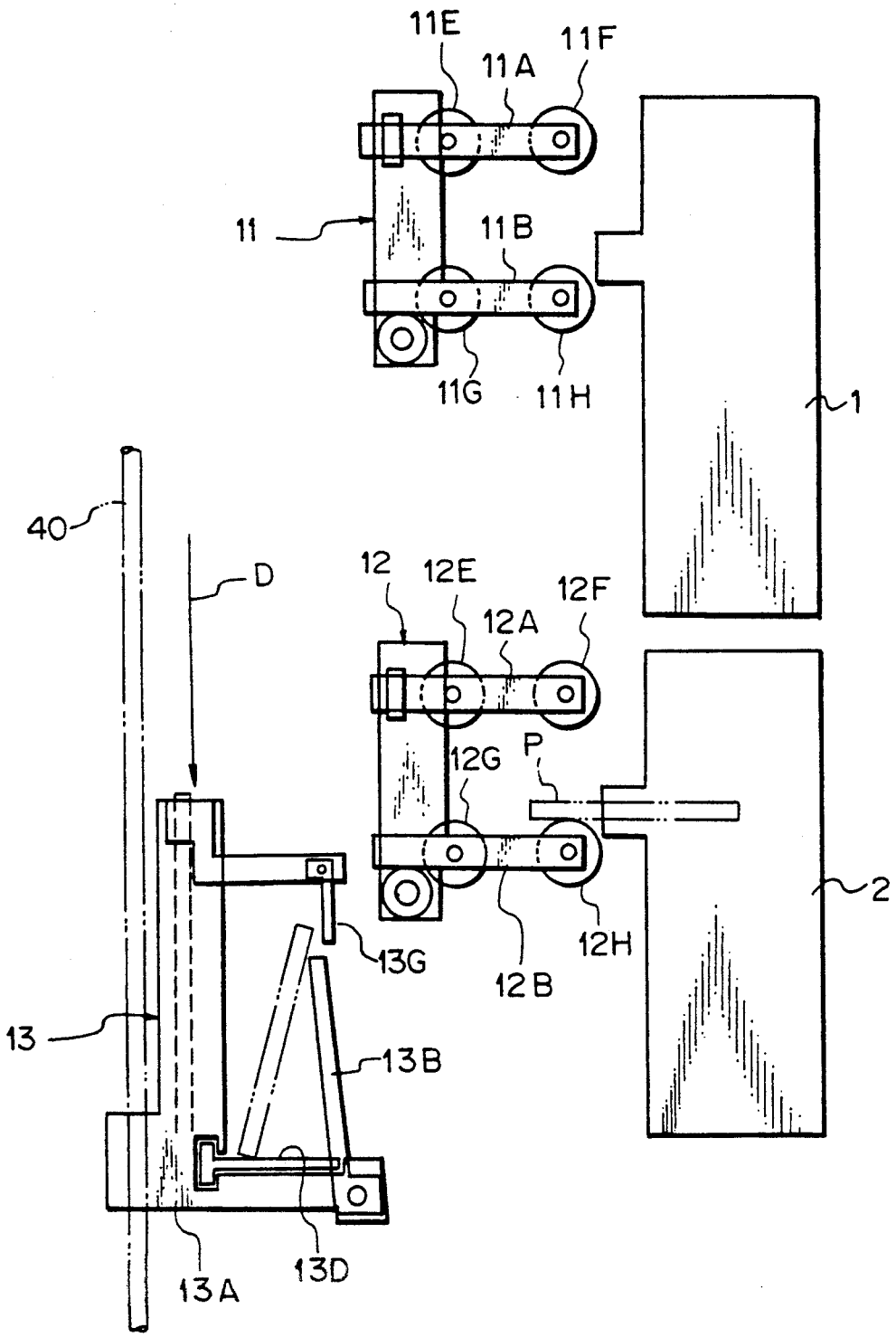
Figure 9:
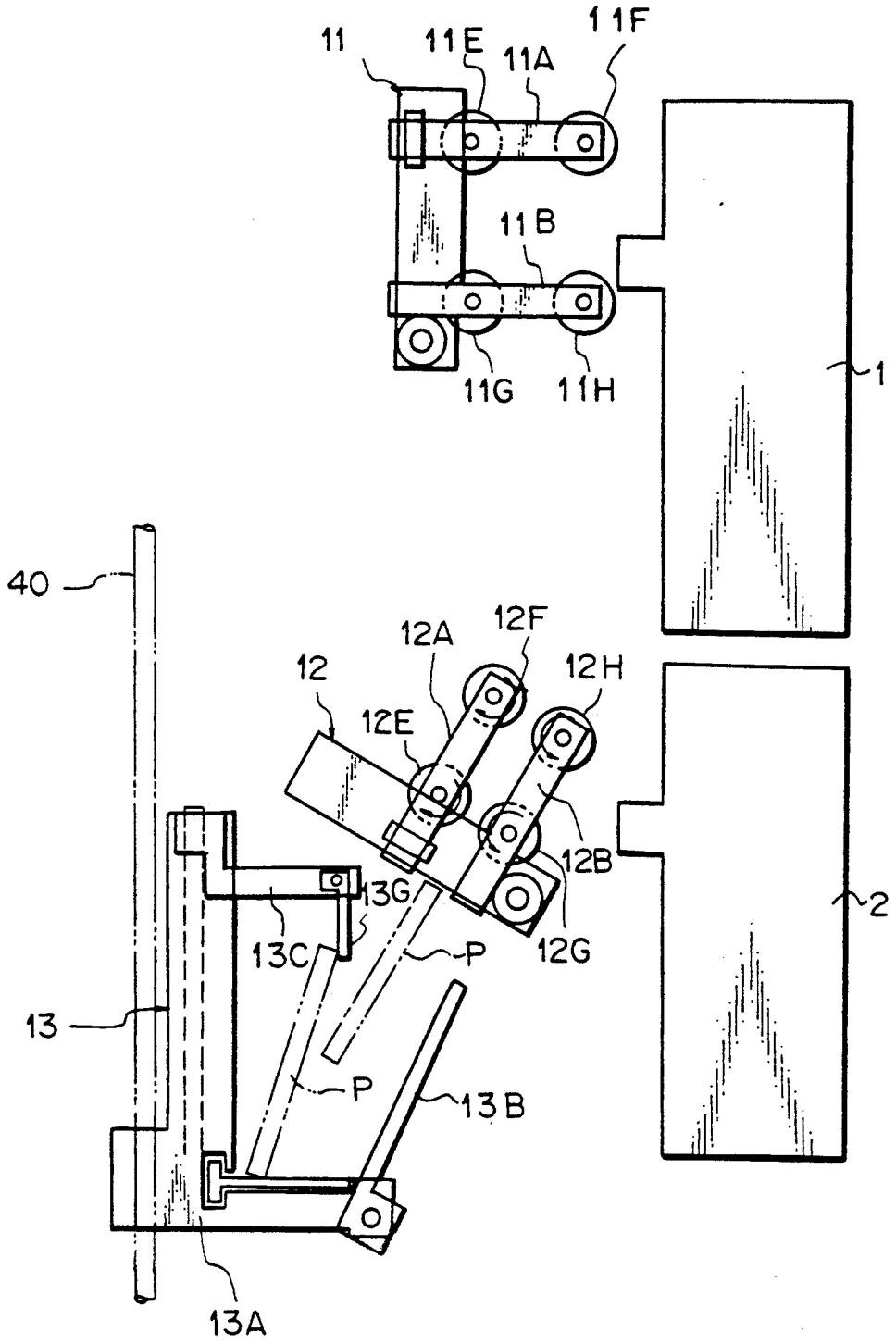
Figure 10:
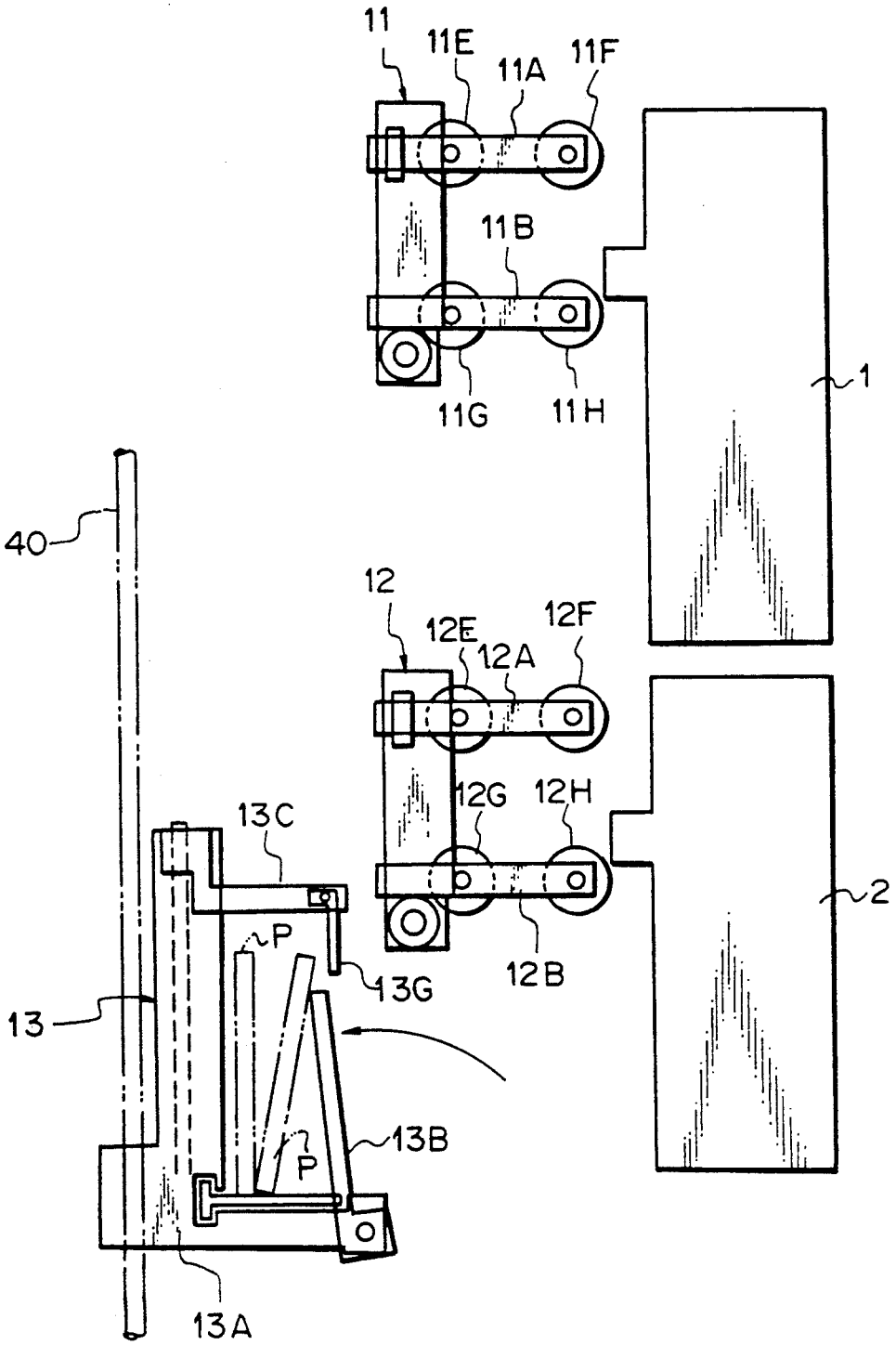

In the above condition, the collection mechanism 13 is lowered in a direction indicated by an arrow D in FIG. 8 to a position beside the other pay-out mechanism 2. Then, the pick-up mechanism 12, like the mechanism 11, draws out a sheet P from the pay-out mechanism 2 and then rotates to feed the sheet P into the collection mechanism 13. Of course, the gate 13B is opened for receiving the sheet P. At this instant, the holder 13G holds the upper edge of the sheet P to thereby prevent it from falling, as shown in FIG. 9. Subsequently, the gate 3B is closed to fully accommodate the sheet P from the pay-out mechanism 2 in the receptacle 13A which has already received the sheet P from the pay-out mechanism 1, as shown in FIG. 10.

Figure 11:
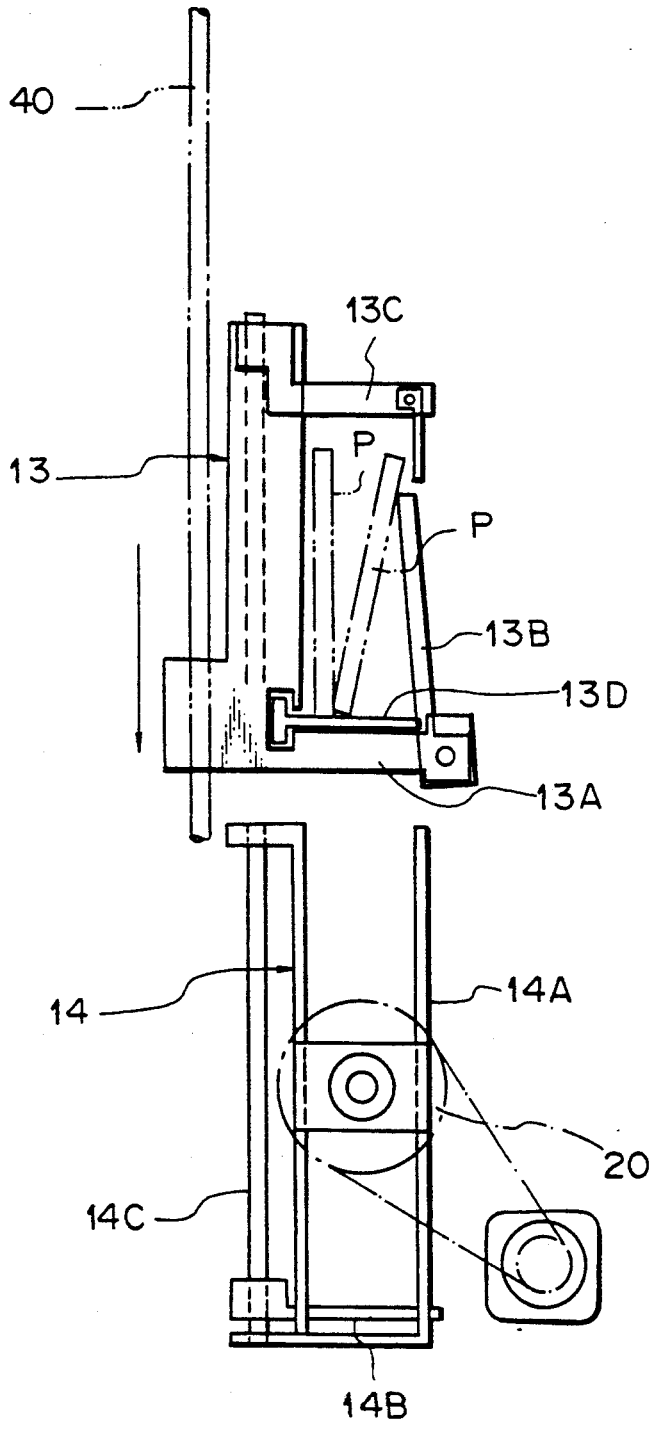
FIGS. 11–17 are views representative of the operation of the sheet delivering section shown in FIG. 2.
Figure 12:
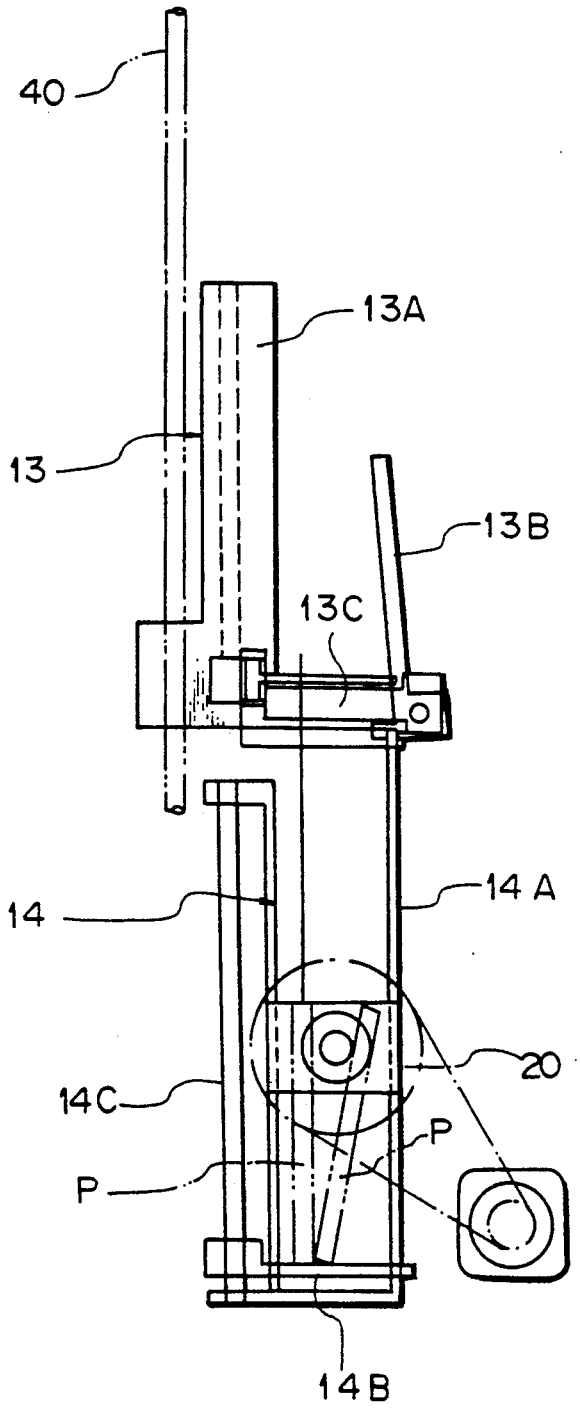

As shown in FIG. 11, the collection mechanism 13 accommodating the sheets P therein is slid downward and then stopped on reaching the transfer mechanism 14. In this condition, the lower slider 13D is moved in a direction perpendicular to the sheet surface of FIG. 11 while the upper slider 13C is lowered. As a result, all the sheets P are handed over to the transfer mechanism 14 at a time, as shown in FIG. 12.

Figure 13:
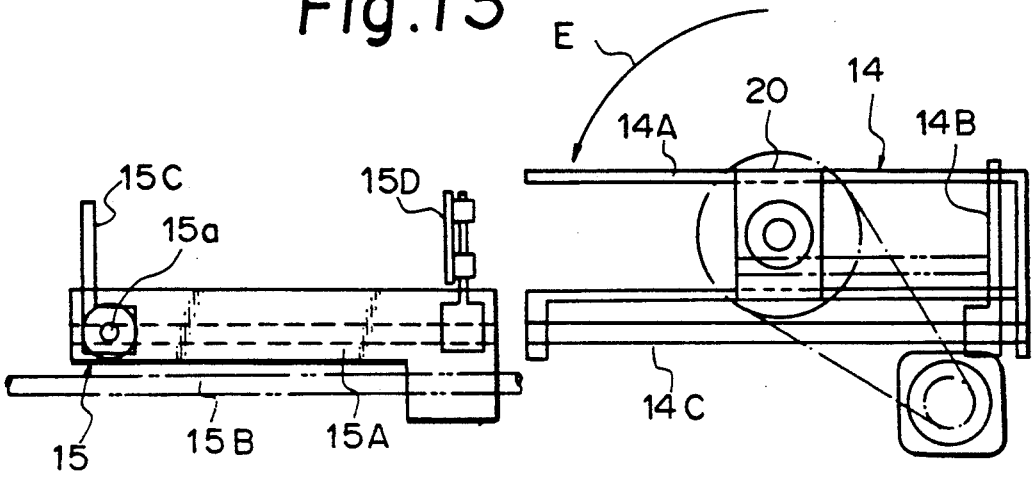

Thereafter, the transfer mechanism 14 is caused to fall sideways toward the transport mechanism 15 in order to change the sheet transport direction, as indicated by an arrow E in FIG. 13. Subsequently, the discharge plate 15D of the transport mechanism 15 is opened in a direction indicated by an arrow F in FIG. 14, and then the push slider 14B of the transfer mechanism 14 is moved toward the transport mechanism 15 in a direction indicated by an arrow G. Consequently, the sheets P are collectively transferred to the carriage 15A of the transport mechanism 15. Then, the discharge plate 15D is returned to the original position in the direction F, as shown in FIG. 15.

Figure 17:
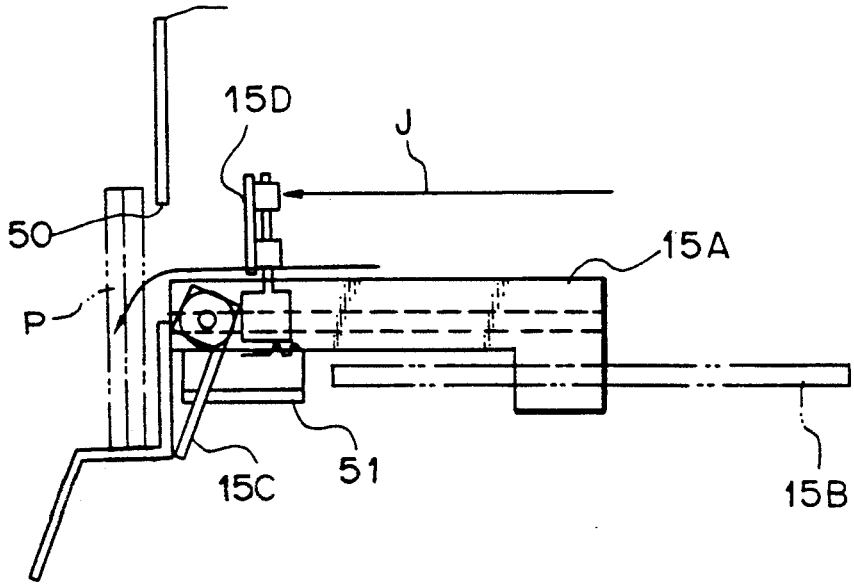

The carriage 15A carrying the sheets P thereon is moved toward the outlet 50 along the linear shaft 15B, as shown in FIG. 16. As the carriage 15A approaches the outlet 50, the pinion **15*a* mounted on the carriage 15A is brought into mesh with and rotated by the rack 51. As a result, the stop 15C of the carriage 15A is rotated in a direction H, FIG. 16, to facilitate the discharge of the sheets P. In this condition, the discharge plate 15D is moved in a direction indicated by an arrow in FIG. 17 to discharge the paper sheets P collectively to the outside of the device via the outlet 50**.

As stated above, the embodiment causes the pick-up mechanism 11 with the rollers 11E–11H to draw out a sheet P from the pay-out mechanism 1 and then rotates the entire pick-up mechanism 11 to accommodate the sheet P in the collection mechanism 13. The embodiment repeats such a procedure the number of times corresponding to the number of pick-up mechanisms 11 and 12. Hence, despite that the device has a plurality of pay-out mechanisms 1 and 2, it is possible to collect all the sheets in a single collection mechanism 13 and drive them out together to the outside of the device via a single outlet 50.

In summary, it will be seen that the present invention provides a sheet transporting device which makes it needless for the operator to pick up sheets from each of a plurality of dispensing mechanisms and substantially prevents the operator from forgetting to pick up sheets. Moreover, a rotatable transfer mechanism located on a sheet transport path allows the direction of sheet transport to be changed, as desired. hence, an outlet for discharging sheets to the outside can be located in any desired position of the device.

Various modifications will become possible for those skilled in the art after receiving the teachings of the present disclosure without departing from the scope thereof.

What is claimed is:

1. A sheet transporting device comprising:

a plurality of pay-out means for paying out sheets;

a plurality of pick-up means each being associated with respective one of said plurality of pay-out means;

collection means for sequentially collecting sheets picked up by said plurality of pick-up means by gravity;

transfer means for receiving the sheets collected by said collection means collectively; and transport means for transporting the sheets received by said transfer means to the outside of said sheet transporting device.

2. A device as claimed in claim 1, wherein said collection means is movable in a reciprocating motion along said plurality of pick-up means and has a gate whose upper end is movable outward at a sheet collecting side of said collection means.

3. A device as claimed in claim 1, wherein said transfer means is disposed below said collection means and capable of rotating about a horizontal axis toward said transport means.

* * * * *